United States Patent [19]

Beny et al.

[11] 4,073,088

[45] Feb. 14, 1978

[54] TOY DOLL

[75] Inventors: Janos Beny, Redendo Beach; John W. Ryan, Los Angeles, both of Calif.; Edward Snyder, III, Dix Hills, N.Y.

[73] Assignee: Ideal Toy Corporation, Hollis, N.Y.

[21] Appl. No.: 747,741

[22] Filed: Dec. 6, 1976

[51] Int. Cl.[2] ..... A63H 33/26

[52] U.S. Cl. ..... 46/265

[58] Field of Search ..... 46/119, 264, 265, 116, 46/163, 164, 118, 120, 266, 268

[56] References Cited

U.S. PATENT DOCUMENTS

| | | | |
|---|---|---|---|
| 3,128,575 | 4/1964 | Stanetzki | 46/120 |
| 3,500,577 | 3/1970 | Bart | 46/134 |
| 3,583,098 | 6/1971 | Bear | 46/247 |
| 3,650,065 | 3/1972 | Johmann | 46/118 |
| 3,693,292 | 9/1972 | Di Leva | 46/247 |

*Primary Examiner*—Louis G. Mancene
*Assistant Examiner*—Mickey Yu
*Attorney, Agent, or Firm*—Richard M. Rabkin

[57] ABSTRACT

The subject doll includes a body, a head rotatably mounted on the body, and a pair of arms having hands formed thereon being articulatedly mounted on the body. A drive mechanism is located within the body for simultaneously rotating the doll's head through a predetermined angle to face towards one side of the body and for moving the arms from a first raised position wherein the hands are spaced from one another at about the level of the shoulders of the body to a second position wherein the hands are positioned adjacent each other near the midriff of the body. When the doll is positioned on a play surface, on its midriff with the doll's hands in their first position, the movements of the doll's head and its hands to their second position will cause the center of gravity of the doll to shift. The doll will then tip over in a direction opposite to the direction in which the doll's head faces in its turned position and thus roll over on its back.

47 Claims, 21 Drawing Figures

12
14
16
16a
18
18a
22

FIG. 4a
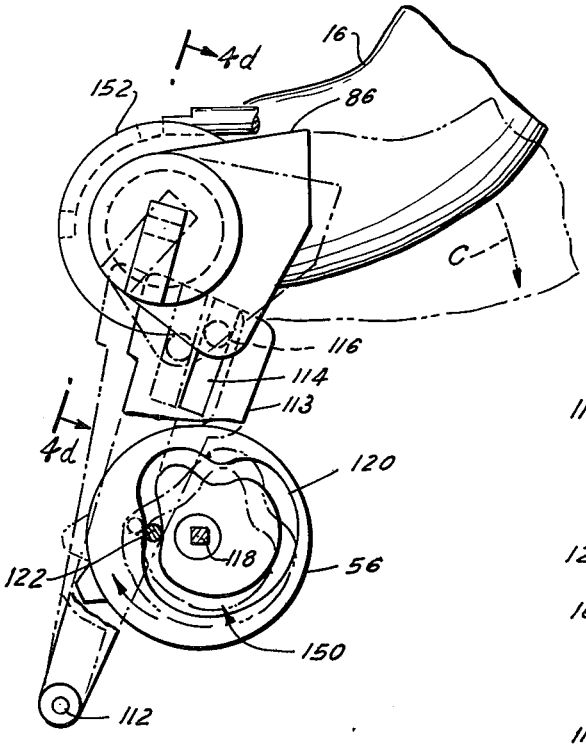
FIG. 4b
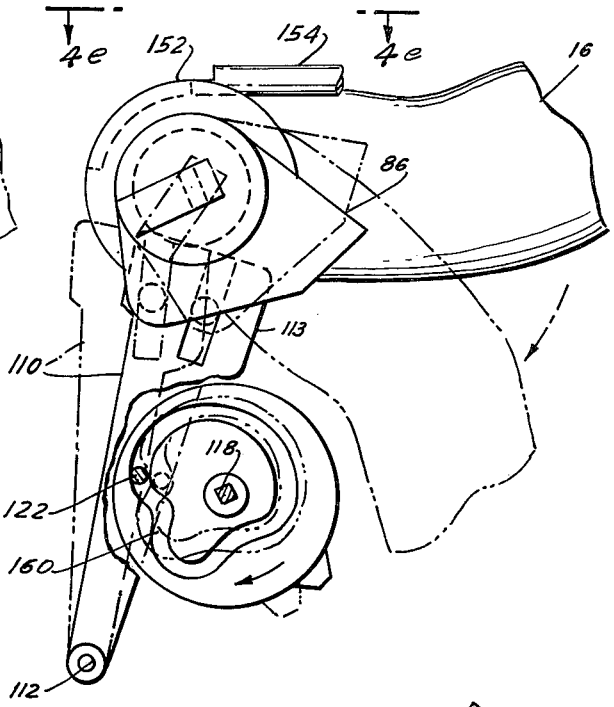
FIG. 4c
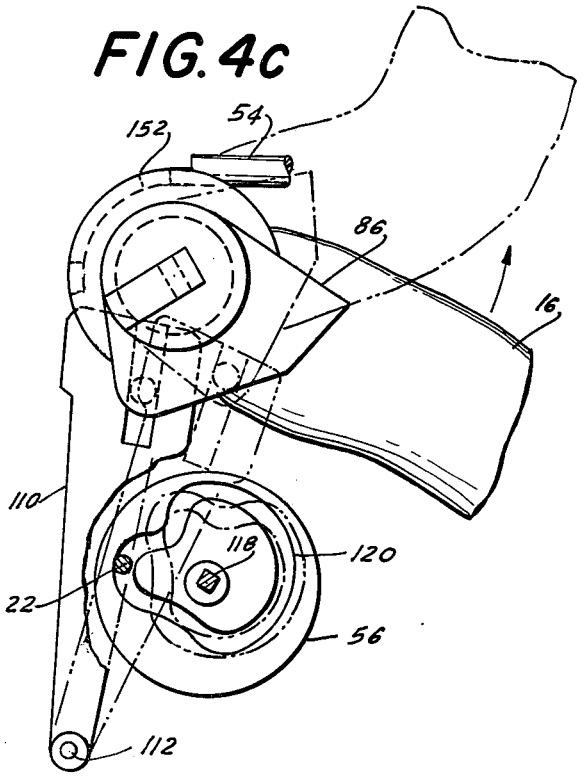
FIG. 4d
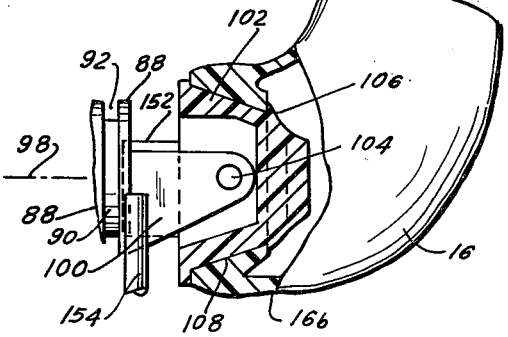
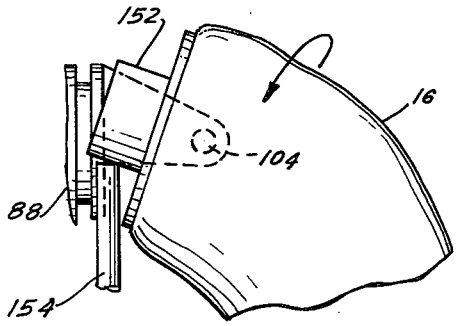
FIG. 4e

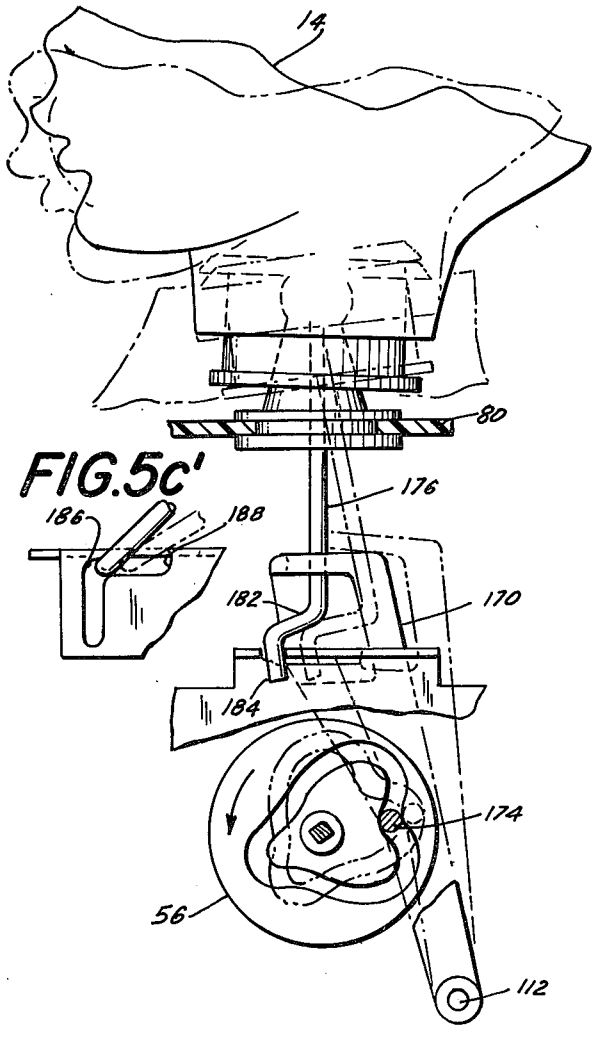
FIG.5c'
FIG.5c
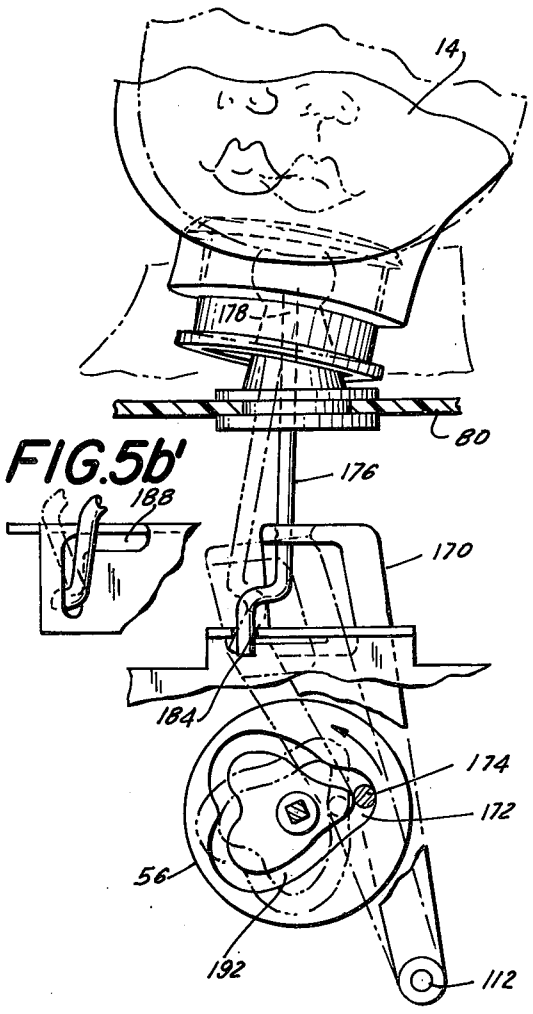
FIG.5b'
FIG.5b
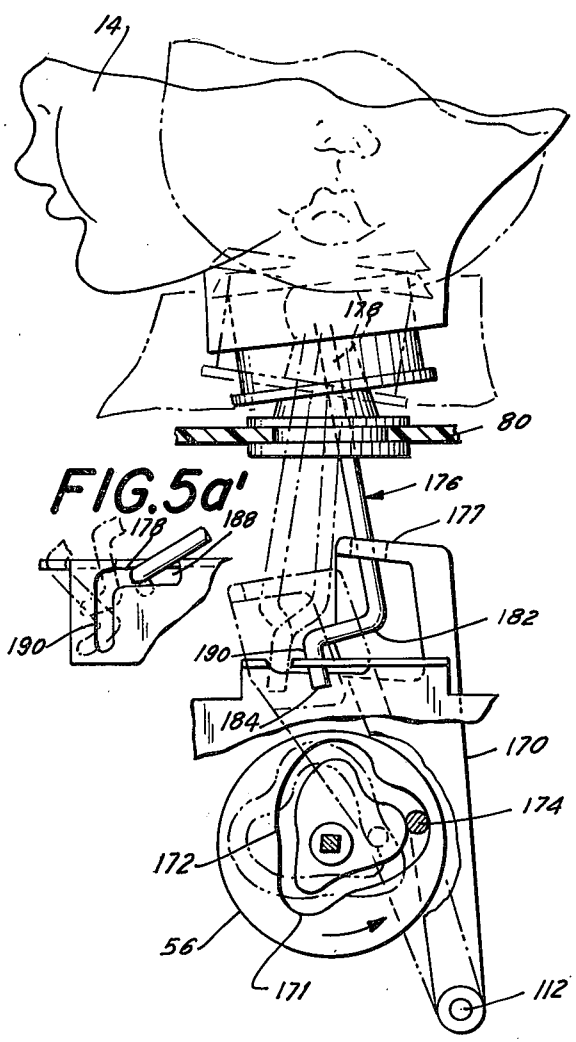
FIG.5a'
FIG.5a

TOY DOLL

The present invention relates to toy dolls and, more particularly, to a mechanical toy doll which can turn over from a prone position on its stomach or midriff to a position lying on its back.

Mechanical toy dolls have been provided in the past which can perform a variety of different motions. The doll of the present invention is constructed to simulate the actions of an infant lying on its stomach and rolling over on its back when awakened. In accordance with broad aspects of the invention the doll's arms and head are driven by a mechanical transmission system whereby, from a starting position with the hands of the doll located at a level approximately at the shoulders of the doll, and with the doll lying on its stomach or midriff, the arms are driven to lower the arms in their spaced relation towards the midriff of the doll, thereby raising the shoulders further from the surface on which the doll is placed. At the same time the head of the doll is oscillated to turn it from a front facing position to a side facing position. The arms of the doll are then operated to move the hands together adjacent the midriff of the doll so that the center of gravity of the doll is shifted, causing the doll to tilt in a direction opposite to the direction in which the head faces. The doll thus rolls over on its back, and the hands and head are returned to their starting positions by the transmission.

Accordingly, it is an object of the present invention to provide a toy doll which includes a drive mechanism causing the doll to roll over from its stomach onto its back.

Another object of the present invention is to provide a toy doll which simulates the actions of a small child lying on its stomach and rolling over on its back when it awakens.

Another object of the present invention is to provide a toy doll which is relatively simple in construction, and durable in use.

A further object of the present invention is to provide a novel arm moving mechanism in a toy doll.

A further object of the invention is to provide a novel head moving mechanism in a toy doll.

A still further object of the present invention is to provide a toy doll having the desired movements, which doll is relatively simple for a child to use.

In accordance with an aspect of the present invention the toy doll includes a body and a head mounted on the body for fore and aft rocking movement and for side to side rotary movement. A pair of arms having opposed head and shoulder end portions are mounted on a frame which is rotatably mounted in the body adjacent the shoulders of the body for rotation along a first axis extending between the shoulders, transversely of the body. Pivot means rotatably mount the shoulder portions of the arms on the frame for pivotal movement about a second axis extending transversely of the axis on which the frame rotates. By this arrangement the arms will rotate simultaneously with the frame about the transverse axis so as to, in effect, move up and down; and they can rotate independently about the second axes, so that the hands can move towards and away from each other.

A drive motor is provided within the body and cooperates with a transmission that is operatively connected between the motor, the head and frame. The transmission is arranged to oscillate the frame between first and second extreme positions about its axis of rotation according to a predetermined pattern selected to move the arms from a first position, corresponding to the first position of the frame wherein the hands are spaced apart at about the level of the shoulders of the body, to a second position wherein the hands are spaced apart at about the level of the doll's midriff, and thence to a third position wherein the hands are adjacent each other at about the level of the doll's midriff. After the doll has tipped over on its back, as described hereinafter, the transmission returns the arms to their first position. In addition, the transmission rotates the head from a front facing position to a side facing position as the arms move from their first to their second position and also returns the head to its front facing position as the doll tips over. Accordingly when the doll is placed on a flat surface on its midriff, with its hands on the surface and its arms in the first position, so that the shoulders of the doll are supported by the arms off of the support surface, movement of the arms from their first to their third positions and rotation of the head to the side facing position will cause the center of gravity of the doll to shift, thereby tipping the doll over on its back in a direction opposite to the direction in which the doll's head faces in the side facing position.

The above, and other objects, features and advantages of this invention will be apparent in the following detailed description of an illustrative embodiment thereof, which is to be read in connection with the accompanying drawings, wherein:

FIG. 1 is a front perspective view of a toy doll constructed in accordance with the present invention and showing the arms of the doll in the first position, before the doll is placed on its stomach or midriff;

FIGS. 1*a*–1*g* are a sequence of views showing the movement of the doll's arms and head as the doll is operated to tip over from its stomach onto its back;

Figure 1:
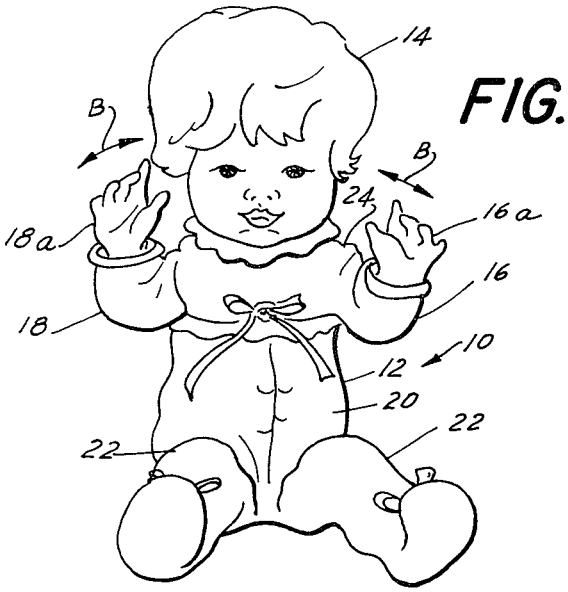

FIGS. 4*a*–4*c* are sequential views showing the transmission mechanism connecting the drive motor to the doll's arms and the sequence of movements of the arms;

FIG. 4*d* is a sectional view taken along line 4*d*–4*d* of FIG. 4*a;*

FIG. 4*e* is a plan view taken along line 4*e*–4*e* of FIG. 4*b;*

FIGS. 5*a*–5*c* are schematic sequential views showing the transmission mechanism connecting the drive motor to the doll's head for tilting and turning the head; and FIGS. 5*a'*–5*c'* are partial plan views of a portion of the transmission mechanism shown in FIGS. 5*a*–5*c* respectively.

Referring now to the drawings in detail, and initially to FIG. 1 and FIGS. 1*a*–1*g*, a doll 10, constructed in accordance with the present invention, is illustrated which includes a body 12 and a head 14 rotatably mounted on the body. The body of the doll consists of a hollow molded plastic torso of generally conventional construction, on which a pair of arms 16, 18 are articulated or rotatably mounted, as described hereinafter. The doll is clothed in a cloth jumpsuit 20, which includes integral stuffed and flexible legs. Although the illustrative embodiment of the invention illustrates a doll using stuffed legs, it is contemplated that the doll may have molded legs articulatedly mounted on the body in any convenient manner and still operate as desired.

In use doll 10 is positioned with its arms 16, 18, raised so that the hands 16a–18a are located at approximately the level of the shoulders 24 of the doll. With the arms in this position the doll is placed on a play surface, as illustrated in FIG. 1a, with the hands 16a–18a spaced apart. The child then presses a tang or actuating switch (not seen in FIG. 1a) in the back of the doll, which is covered by the jumpsuit 20. Actuation of this switch causes battery powered motor in the body of the doll to operate and drive a transmission mechanism which initially moves the doll's arms 16, 18 from the position shown in FIG. 1a, in planes extending generally parallel to the sides of the body, to the position shown FIG. 1b. At the same time the head 14 is tilted and rotated from its normal front facing position through substantially 90° to a side facing position. To add an additional degree of realism to the actions of the doll, the head is rotated back and tilted forwardly slightly from the position shown in FIG. 1b to the position shown in FIG. 1c, through approximately 45°, while the hands of the doll remain generally stationary. The head then is again rotated back to its fully tilted and side facing position, as illustrated in FIG. 1d, and at about the same time the arms are rotated to move hands 16a, 18a towards each other adjacent the midriff of the doll. This movement of the hands, as well as the tilted or turned position of the head, causes the center of gravity of the doll to shift, so that the doll's body tilts in the direction opposite to the direction in which the doll's head is facing whereby the doll rolls over on its back.

As the doll rolls over on its back, as illustrated in FIG. 1f, head 14 is turned back towards it normal front position and, at about the same time arms 16, 18, are rotated by the drive mechanism to return them to their first position where the hands are located at about the level of the shoulders and spaced from each other, as illustrated in FIG. 1g. It is noted that in the drawings the soft flexible legs of the doll are crossed at the ankles. This aids in locating the center of gravity of the doll at a position wherein a slight shift due to movement of the arms and head as described above will cause the center of gravity to shift sufficiently to allow the doll to tilt over on its back. However, crossing of the legs is not required in order for the doll to operate satisfactorily, particularly with molded leg dolls.

Figure 3:
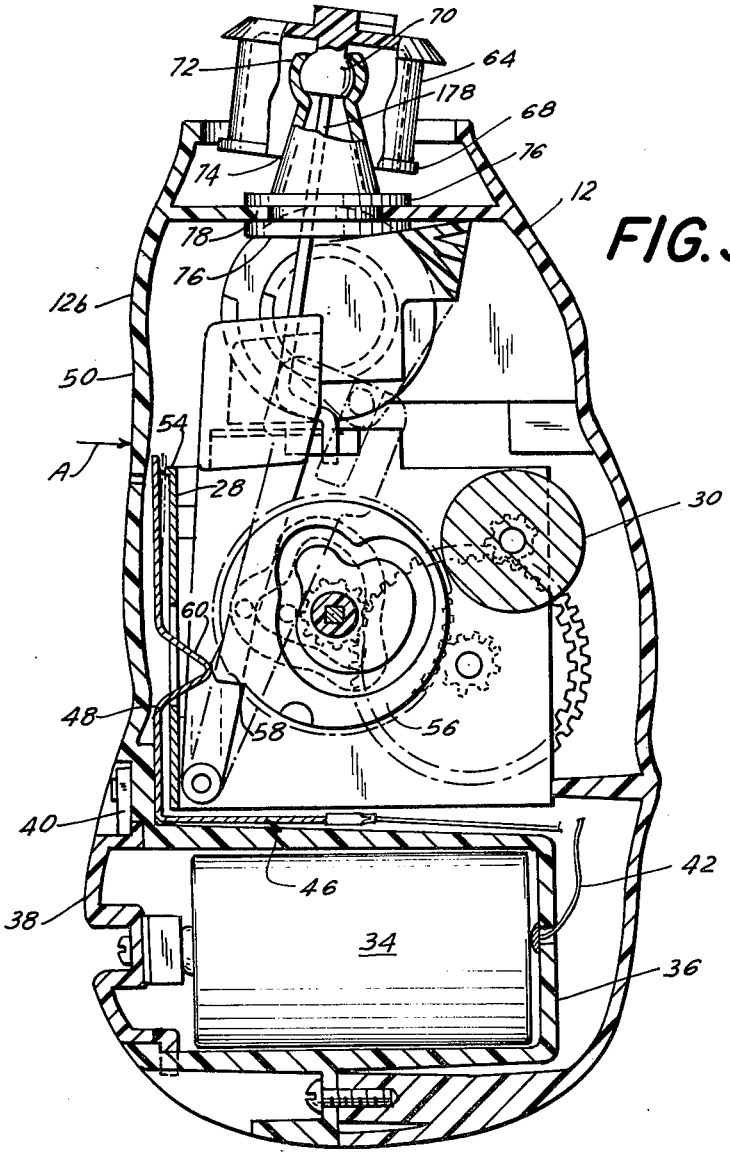
FIG. 3 is a longitudinal side sectional view of the assembled doll, but with the head removed.
Figure 2:
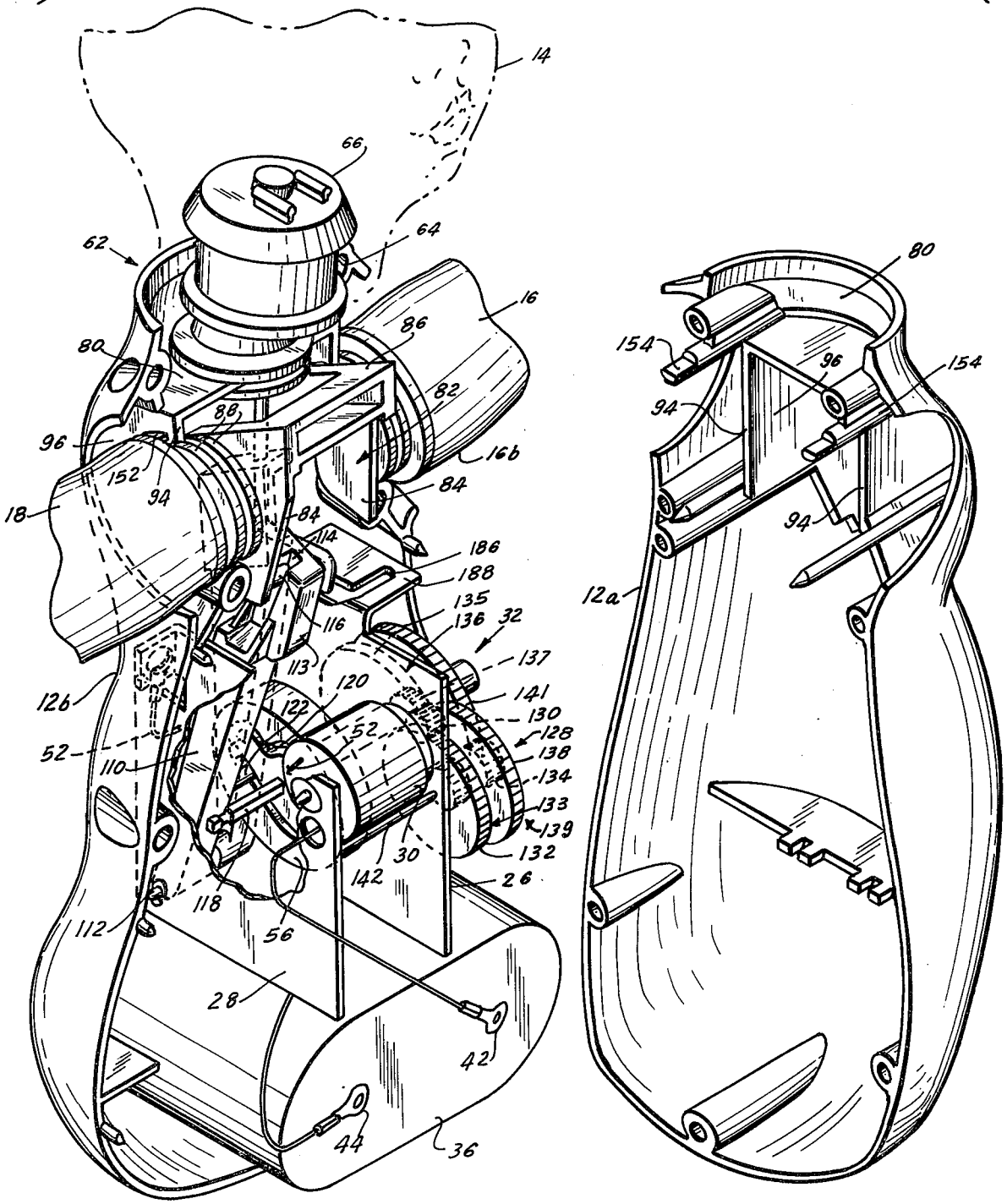
FIG. 2 is a partial exploded perspective view, with parts broken away, showing the interior drive and transmission mechanism of the doll.

Referring now to FIGS. 2 and 3 of the drawing, the doll's body 12 is formed from two molded torso sections 12a, 12b respectively defining the front and back of the doll. The torso sections are connected together by screws (not shown) or the like, in any convenient and conventional manner. A metal frame comprising a pair of spaced plates 26, 28 are mounted within the rear torso section 12b, in any convenient manner, and provides mounting support for a drive motor 30 and transmission mechanism 32 which operate to drive the arms and head as described above.

Motor 30 is operated from a pair of batteries 34, (only one of which is seen in FIG. 3), which are inserted within a hollow battery casing 36 integrally molded in rear torso portion 12b. Access to casing 36 is provided by a removable cover 38 which is held in position by a pivoted latch 40 rotatably mounted on the back of torso portion 12b. One of the terminals 42 of battery casing 36 is connected to motor 30 and the other terminal 44 is connected to a resilient contact spring element 46 which has a generally L-shaped configuration including a vertically extending leg 48 located along the rear of torso portion 12b. The rear torso portion has a flexible tang 50 formed in its back which is adapted to be pushed, as indicated by the arrow A, to depress spring leg 48 against the metal frame element 28. This frame element is connected by a wire 52 to motor 30.

In operation leaf spring leg 48 is normally engaged at point 54 with frame element 28, as indicated in dotted lines in FIG. 3. In this manner the circuit is completed and power is supplied to the motor which, in turn, drives transmission 32. This transmission includes a cam element 56 that has a protuberance 59 formed thereon. At the completion of one revolution of cam 56, protuberance 58 engages the protuberance or bend 60 on contact spring 48 and urges the spring away from frame contact point 54, thereby cutting off supply of power to motor 30. When it is desired to operate the doll, tang 50 is depressed to urge the spring against contact point 54, thereby causing the motor 30 to operate. Operation of the motor rotates cam 56 and thus disengages protuberances 58, 60. Tang 50 then can be released and the spring contact 48 will remain engaged with frame contact point 54 so that motor 30 continues to operate.

The doll's head 14 is mounted on doll body 12 by a universal joint mounting arrangement 62. This joint includes a first cylindrical cap member 64 and a tapered conical flange 66 at its upper end which is frictionally received within the neck of the doll's head 14 in the conventional manner. Cylindrical cap 64 is hollow and has an open bottom 68 which includes an integral spherical ball 70 located interiorally on the central axis of the cap. This ball is received in a spherical cup 72 integrally formed on the top of a frustro-conical mounting member 74. The base of the mounting member 74 has a pair of integral rings 76 formed thereon defining a groove 78 therebetween. Flanges 80 on the front and rear torso members 12a, 12b are received in this groove, as seen in FIGS. 2 and 3, to hold the mounting member 74 in a relatively fixed position. However the ball and socket arrangement 70, 72 permits cap 64 and thus head 14 to be rotated or oscillated in a fore and aft direction as well as from a side to side direction. The ball 70 is operatively connected to the transmission 32, as described hereinafter, so that the head is moved in a predetermined pattern when motor 30 is operated.

Arms 16, 18, are rotatably mounted in torso 12 on a generally U-shaped frame member 82. This frame member has a pair of depending leg portions 84, respectively associated with each of the arms, and a central bight portion 86. As seen in FIGS. 2 and 4d (wherein only one of the leg members is shown) the legs 84 have a pair of cooperating integral spaced bearing members or rings 88 formed thereon connected by a cylindrical bearing member 90 of lesser diameter to define a groove 92 therebetween. This groove receives the edge portion 94 of forwardly extending torso flanges 96 integrally formed with torso section 12b. The forward edges 94 of the flanges 96 on the rear torso section have semi-circular configurations (not seen in the drawing) which closely mate with bearing surfaces 90 and permit rotation of the frame 82.

Front torso section 12a has corresponding flanges 96 formed thereon, but the front edges 94 of these flanges are straight vertical edges. These edges are also received in groove 92 between bearing elements 88 and prevent forward movement or shifting of the frame in the torso. In this manner the frame is mounted for rotation about a first axis 98 (FIG. 4d) which extends transversely of the torso between the shoulders of the doll's body.

The flanges 84 of frame 82 include outwardly extending connection elements 100 to which an arm mounting cap 102 is pivotally mounted by a pin 104. The pin 104 permits cap 102 to pivot about an axis which extends transversely of axis 98. In the raised position of the arms, shown in FIGS. 1 and 4*d*, pin 104 extends generally horizontally.

The connecting element or cap 102 has a generally conical configuration, with an annular tapered flange extension 106 formed thereon and is received within the shoulder end portion of the arms. The ends 108 of the shoulder end portion of the arms tightly frictionally receive the peripheral surface of their associated mounting cap 102 so that the arm is held thereon is a relatively fixed position. By this arrangement, in the raised position of the arms, with the axes of pivot pins 104 extending generally horizontally, the arms can pivot so that the hands can move freely in and out with respect to the doll's body, as illustrated by the arrows B in FIG. 1. When the doll is used, the child holds the arms out as far as possible, in the position shown in FIG. 1, and places the doll on its stomach with the hands spread apart in this position.

The arms 16, 18 are moved by rotation of frame 82 through the transmission mechanism 32 which includes a lever 110 pivotally mounted on a shaft 112 extending between frame members 26; 28. The lever has an upper end 113 including an axial slot 114 formed therein. This slot receives a crank pin 116 integrally formed with one of the legs 84 of frame 82. By oscillating level 110 about shaft 112, in a fore and aft direction, pin 116 will slide in slot 114 and cause frame 82 to rotate on axis 98.

Lever 110 is oscillated by cam 56. This cam is a disc shaped element fixed to a shaft 118 which is rotatably mounted in the frame elements 26, 28 as illustrated in FIG. 2. The cam has a groove 120 formed on its face adjacent lever 110. This groove has a predetermined configuration, selected according to the desired movement of the arms 16, 18. The groove receives a follower pin 122 integrally formed with lever 110 so that rotation of cam 56 causes pin 122 to follow along in groove 120, thereby oscillating lever 110.

Cam 56 is rotated from motor 30 through a gear train 128. This gear train includes a spur gear 103 rigidly connected to the output shaft of motor 30 and meshingly engaged with the larger gear 132 of a compound gear 133. This gear is rotatably mounted on a shaft 142 fixed to frame members 26, 28. The integral smaller gear 134 of compound gear 133 is engaged with the larger gear 135 of a compound gear 136 which is rotatably mounted on the square cam shaft 118. The smaller gear 137 of compound gear 136 is meshingly engaged with the larger gear 138 of compound gear 139, and the smaller gear 140 of this compound gear is meshingly engaged with a spur gear 141 fixed to square shaft 118. Compound gear 139 is rotatably mounted on a shaft 142 coaxial with gear 133. In this manner the relatively high speed of rotation of motor 30 is geared down to a relatively low speed of rotation imparted to shaft 118.

The operation of cam 56 and rotation of the arms 16 is illustrated in FIGS. 4*a*–4*c*. In the initial position, shown in solid lines in FIG. 4*a*, groove 120 receives pin 122 of lever 110 at the position shown. When the tang 50 is depressed, in order to initiate operation of the motor 30, gear train 128 rotates cam 56 in a single continuous revolution in a clockwise direction as seen in the drawing. Initially the cam moves to its dotted line position and urges pin 122 rearwardly, thereby moving lever 110 to the left or phantom line position in FIG. 4*a*. This movement also moves crank pin 116 on frame 82 to the left, so that arm 16, as well as arm 18 are simultaneously moved downwardly, as indicated by the arrow C in FIG. 4*a*. In this manner the arms are moved in planes parallel to the sides of the body's torso, so that hands 16*a*, 18*a*, are moved downwardly in spaced relation to each other towards the midriff of the doll's body (FIG. 1*b*). Becuase the hands of the doll are engaged with the play surface the hands remain in their relatively spaced relation and are held against pivotal movement towards or away from each other. Once cam 56 has rotated sufficiently so that pin 122 enters the constantly sloped and slightly outwardly extending groove section 150 of groove 120, the arms are substantially at their full downward position and further rotation of the cam, passing groove section 150 past pin 122, causes only slight further downward movment of the hands (FIGS. 1*c* and 1*d*). As the cam continues to rotate through the slightly sloped groove portion 150 of cam 54 head 14 is moved by the transmission mechanism, as described hereinafter, from the position shown in FIG. 1*b* through the positions shown in FIGS. 1*c*, 1*d* and 1*e*.

When the head has moved back to the position shown in FIG. 1*e*, arms 16, 18 are moved to draw hands 16*a*, 18*a* together. This motion is illustrated in FIGS. 4*b* and 4*e*. In order to achieve this result the connecting elements 102 associated with each of the arms includes a stop member 152 integrally formed therewith and extending through an arcuate segment over the extension arm 100. Rotation of frame 82 brings the arms to their second position (shown in solid lines in FIG. 4*b*) and brings these stops 152 into abutment with extension pins 154 formed on the front torso portion 12*a* of the doll. Engagement of these stops with extensions 154 tends to prevent further rotary movement of the arms with the frame 82. However, because the grooved section 150 of the cam 120 moves outwardly towards the periphery of cam 56 the pin 122 is continuously driven slightly towards the rear of the doll, thus continuously moving pin 116 slowly towards the rear and causing frame 92 to contiue to pivot forwardly in a clockwise direction in FIGS. 4*a* and 4*b*. Motion of frame 82 is permitted because the engagement of abutment 152 against extension 154 will cause arms 16, 18 to pivot out of the way, at the shoulder end portions thereof, thereby moving hands 16*a*, 18*a* towards each other, as illustrated in FIG. 4*e*. Thus frame 82 continues to rotate slightly while the arms are driven inwardly so that the hands are positioned adjacent each other near the midriff of the torso. Thus the arms, as shown in the phantom line position of FIG. 4*b* and in FIG. 1*e* have been moved inwardly. The doll then rolls over on its back and pin 122 enters the irregularly curved portion 160 of groove 150 so that the arms are moved outwardly, into the position shown in FIG. 1*g* . This movement is shown in FIG. 4*c*, where the inner position of the arms is shown in solid lines and the outer position of FIG. 1*g* is shown in phantom lines.

The head 14 is moved in a coordinated manner with arms 16 by the same cam 56. For this purpose, the transmission mechanism includes an additional lever 170 pivotally mounted on shaft 112 in laterally spaced relation to lever 110. Cam 56 extends between the two levers and its side face adjacent lever 70 includes an endless groove 172 having a predetermined configuration in order to oscillate lever 170 in a fore and aft direction in the desired manner. Lever 170 has a follower pin 174 received in groove 172 so that the latter will follow the cam and oscillate fore and aft.

Oscillating motion of the lever is transmitted to the head in a predetermined sequence by means of a crank element 176 having a first end portion 178 (see FIG. 3) rigidly secured to ball 70. The intermediate portion of the crank is freely rotatably received in an opening 177 formed in the upper end of lever 170. And, the second or opposite end portion of crank 176 is bent into a generally L-shaped configuration, including a first leg 182 which extends perpendicularly to the intermediate section of crank 176 and a second leg 184 which extends perpendicularly to leg 182 and parallel to the intermediate portion of the crank. The second end portion 184 is received in a generally L-shaped slot 186 formed in a flange 188 at the upper end of frame member 26. The L-shaped slot includes a first leg 188 located in a fore and aft direction and a second leg 190 extending transversely of the torso, parallel to the axis 98 on which frame 82 rotates.

In the starting position iluustrated in FIGS. 1*a* and 5*a* the follower pin 174 of lever 170 is received in the groove 172 in the position illustrated. At this position the end 184 of the crank 176 is located near the rear end of slot 188. Cam 56 is rotated by operation of the motor 30, as described above, and, as veiwed in FIG. 5*a*, rotates in a counterclockwise direction. Because of the configuration of groove 172 the initial rotation of the cam moves follower pin 174 forwardly in the doll, thereby pivoting lever 170 in a generally counterclockwise direction. This moves the crank 176 forwardly in slot leg 188 from the solid position to the intermediate phantom line position shown in FIG. 5*a*. This movement tilts head 14 rearwardly, and in effect lifts the doll's face upwardly. Continued rotation of the cam 56 in a counterclockwise direction, to the dotted line position shown in FIG. 5*a*, near the point 171 of the "heart" shaped groove, continues to drive the lever 170 and crank 176 forwardly. However, because of the dimensions of slot leg 188, continued forward movement of the end 184 of the crank is prevented. As a result this end of the crank enters into the transverse leg 190 of the slot, and crank 176 rotates as a result. This rotational movement of the crank causes ball 70 and thus head 14 to rotate through approximately 90° to the side facing position of the head. This is the position shown in FIG. 1*b*.

Further rotation of cam 56, as illustrated in FIG. 5*b*, causes follower 174 to move over the point 171 of the heart shaped groove 172. This movement drives lever 170 in a clockwise direction, from the position shown in phantom lines in FIG. 5*a* to the solid line position, and thus pulls crank 176 rearwardly a small distance. As a result the head is rotated back towards the front facing position through approximately one half of its original movement. After the pin has moved past the point 171 of the heart shaped groove, it enters the relatively flat, but outwardly extending, groove portion 192, and the head thus returns to its fully turned position, illustrated in phantom lines in FIG. 5*b*, as the pin passes closest to shaft 112. This position of the head corresponds to the position of the doll shown in FIGS. 1*d* and 1*e*. At approximately the same time as the head returns to its fully turned position, arms 16, 18 are moving towards each other to position the hands 16*a*, 18*a* adjacent each other as shown in FIG. 1*e*; this is the movement shown in FIG. 4*b*. This movement causes the center of gravity of the doll to shift slightly towards the right of the doll, and in turn causes the doll to tip over on its back, as illustrated in FIG. 1*f*. As the doll tips over rotation of the cam 45 causes the head to rotate back to its front facing position as the end 184 of lever 176 escapes transverse slot portion 190. At the same time the arms 16, 18 are rotated to raise the arms to a position adjacent the doll's shoulder level (See FIG. 1*f*).

Figures 1A, 1B, 1C, 1D, 1E, 1F, 1G:
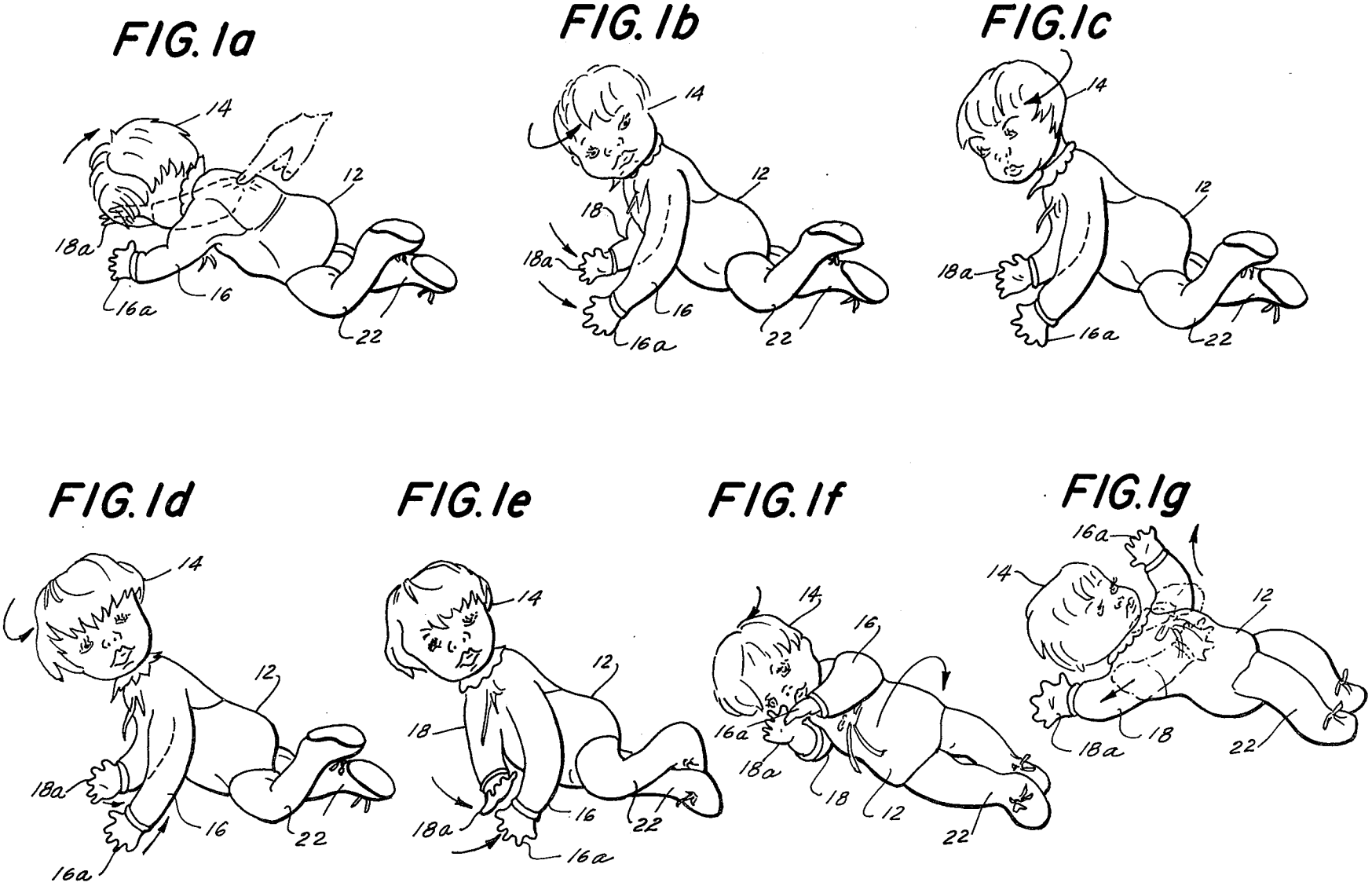

It is noted, as illustrated in FIG. 1, that preferably the right arm 18 of the doll is formed such that its hand 18*a* is located at a level slightly above the level of hand 6*a*. In this manner when the hands move together hand 18 will move up off of the support surface above hand 16 to facilitate tilting movement of the doll. In addition, the stop or abutment 152 associated with arm 18 is located to be slightly forwardly of the corresponding abutment on the arm 16 so that the arm 18*a* begins to move inwardly before arm 16, thus producing a slight bias in the forces applied through the arms to the doll, tending to tilt the doll towards its right side so that it will roll over on its right arm in the direction opposite from the direction in which the doll's head is facing.

After the doll has rolled over on its back, continued rotation of the cam 56, as shown in FIG. 5*c*, presents the top portion of the heart shaped groove 172 to pin 174 and this causes lever 170 to be rotated in a clockwise direction from the solid line position shown in FIG. 5*c* to the dotted line position. This rotation moves crank 176 rearwardly in the doll and causes the end portion 184 to enter the leg 188 of the slot 186 and move towards its rear, thereby tilting the doll's head back down. Accordingly, the effect of the doll's head movement is to first have the doll's head raised from the position shown in FIG. 1*a*, in an aft direction, and then rotated through 90°. The doll's head then rotates back slightly towards the front face position and then returns to the fully turned position simulating a child nodding and turning its head. After the doll's head reaches its fully turned position a second time, the doll rolls over because this movement of the doll's head, coordinated with the simultaneous inward movement of the doll's arms, causes the center of gravity to shift. When the doll rolls over on its back, the doll's head returns to its front facing position and then moves downwardly, simulating a nod. At the same time the doll's arms open up from their closed position illustrated in dotted lines in FIG. 1*g* to their open position illustrated in solid lines. The combined movement of the head and opening arms simulates a lifelike action of a child.

Accordingly, it is seen that relatively simple mechanical structure has been provided for a doll which will simulate a plurality of movements typically performed by a young child or infant when rolling over from its stomach onto its back. While the movements are themselves fairly complicated, the mechanism by which the movements are produced according to the present invention are relatively simple, inexpensive in construction and durable in use.

Although an illustrative embodiment of the present invention has been described herein with reference to the accompanying drawings, it is to be understood that the invention is not limited to that precise embodiment and that various changes and modifications may be effected therein by one skilled in the art without departing from the scope or spirit of this invention.

What is claimed is:

1. A toy doll comprising a body, a head rotatably mounted on said body, a pair of arms having hands formed at one end thereof and opposed shoulder end portions articulatedly mounted on said body for rotation in planes substantially parallel to the sides of said body and for rotation transversely of said body; and drive means in said body for simultaneously rotating said head and moving said arms in a predetermined sequence wherein the head is rotated from a front facing position through a predetermined angle to face towards one side of the body and said arms simultaneously are moved first in said planes substantially parallel to the body from a first position wherein the hands on said arms are spaced from one another at about the level of the shoulders of the body to a second position wherein the hands are spaced from each other at about the level of the midriff of the body and then moved transversely of the body to a position wherein the hands are adjacent each other in front of the midriff of the body whereby when the doll is positioned on a play surface on its midriff and with the doll's hands in said first position against the play surface, said movements of the doll's head and hands will cause the center of gravity of the doll to shift and the doll to tip over in a direction opposite to the direction in which the doll's head faces in its turned position.

2. A toy doll as defined in claim 1 wherein said drive means includes means for returning said head and arms to substantially the same positions they occupied at the start of their movements.

3. A toy doll comprising a body, a head rotatably mounted on said body, a pair of arms respectively having opposed hand and shoulder end portions; means in said body engaged with said arms for rotatably mounting the shoulder end portions in said body for rotation about a common first axis extending transversely through the body between the shoulder end portions of the arm and second axes respectively associated with the arms extending transversely of said first axis, and drive means in said body for rotating said arms simultaneously and automatically, first about said first axis from a first position wherein the hands are at the level of the doll's shoulder and, after a predetermined amount of rotation about said first axis when the hands have reached a second position adjacent the doll's midriff, then about said second axes to bring said hands towards each other over the doll's midriff.

4. A toy doll as defined in claim 3 wherein said doll's arms are mounted on said mounting means in predetermined positions with respect to each other such that one hand is at a slightly higher elevation than the other in said first position.

5. A toy doll as defined in claim 4 wherein said drive means includes means for rotating the doll's head from a first front facing position to a second side facing position during movement of said arms from their first to their second position.

6. A toy doll as defined in claim 5 wherein said one hand is on the side of the doll opposite to the side which the doll's head faces in said second position.

7. A toy doll as defined in claim 4 wherein said drive means for commencing rotation of said one arm about its associated second axis before rotation of the other arm about its second axis.

8. A toy doll comprising a body, a head rotatably mounted on said body, a pair of arms respectively having opposed hand and shoulder end portions; means in said body engaged with said arms for rotatably mounting the shoulder end portions in said body for rotation about a common first axis extending transversely through the body between the shoulder end portions of the arm and second axes respectively associated with the arms extending transversely of said first axis, and drive means in said body for rotating said arms simultaneously about said first axis from a first position wherein the hands are at the level of the doll's shoulders and, after a predetermined amount of rotation when the hands have reached a second position adjacent the doll's midriff, about said second axes to bring said hands towards each other over the doll's midriff; said doll's arms being mounted on said mounting means in predetermined positions with respect to each other such that one hand is at a slightly higher elevation than the other in said first position; and said drive means including means for rotating the doll's head from a first front facing position to a second side facing position during movement of said arms from their first to their second position and means for rocking said head in a fore and aft direction.

9. A toy comprising a body, a head rotatably mounted on said body, a pair of arms respectively having opposed hand and shoulder end portions; means in said body engaged with said arms for rotatably mounting the shoulder end portions in said body for rotation about a common first axis extending transversely through the body between the shoulder end portions of the arm and second axes respectively associated with the arms extending transversely of said first axis, and drive means in said body for rotating said arms simultaneously about said first axis from a first position whereby the hands are at the level of the doll's shoulders, and, after a predetermined amount of rotation, when the hands have reached a second position adjacent the doll's midriff about said second axis to bring said hands towards each other over the doll's midriff; said drive means including means for returning said arms to said first position after the hands have been moved towards each other over the doll's midriff and means for stopping the drive when said hands return to said first position.

10. In a toy doll having a body, a head mounted on said body, and a pair of arms respectively having opposed hand and shoulder end portions articulated on said body for movement in a plurality of planes and being adapted to be placed on its midriff on a play surface with its hands on the play surface and its arms in a first position wherein the hands are spaced apart at the level of the shoulders of the body to support the shoulder portions of the doll's body off of the play surface; the improvement comprising means for causing said doll's body to tilt and turn over on its back including drive means in said body for automatically and continuously moving said arms from said first position to a second position wherein the hands are spaced apart at about the level of the doll's midriff and thence to a third position wherein the hands are adjacent each other at about the level of the doll's midriff whereby movement of said arms from said first to said second position will cause said doll's body to tilt and turn over on its back.

11. A toy doll as defined in claim 10 wherein said arms are mounted on said body in predetermined relative positions with one of said hands at a slightly higher level than the other hand in the first position of said arms whereby said one hand moves above said other hand in the third position of the doll's arms thereby causing the doll's body to tilt towards the side of said one hand.

12. A toy doll as defined in claim 11 wherein said drive means includes means for initiating movement of said one hand from said second to said third position before movement of said second hand to said third position is started.

13. A toy doll as defined in claim 10 including means in said body for mounting said head on the body for side to side rotary movement.

14. A toy doll as defined in claim 13 wherein said drive means includes means for rotating said head from a front facing position to a side facing position during movement of said arms from said first to said second position.

15. A toy doll as defined in claim 14 wherein said drive means includes means for returning said arms to said first position and said head to said front facing position after said arms reach said third position.

16. A toy doll as defined in claim 13 wherein said articulating means includes a frame rotatably mounted in said body adjacent the body's shoulders for rotation along a first axis extending between said shoulders transversely of the body and pivot means for rotatably mounting the shoulder portions of said arms on said frame for pivotal movement about second axes extending transversely of said first axis whereby the arms will rotate simultaneously with said frame about said first axis and can rotate independently about said second axes.

17. A toy doll comprising a body, a head rotatably mounted on said body for side to side rotary movement, a pair of arms respectively having opposed hand and shoulder end portions, means in said body for articulating said shoulder end portions of the arm on the body for movement in a plurality of planes, and drive means in said body for moving said arms from a first position wherein the hands are spaced apart at about the level of the shoulders of the body to a second position wherein the hands are spaced apart at about the level of the doll's midriff and thence to a third position wherein the hands are adjacent each other at about the level of the doll's midriff whereby when the doll is placed on its midriff on a play surface with its hands on the play surface and its arms in said first position supporting the shoulder portions of the doll off of the play surface, movement of said arms from said first to said second position will cause said doll's body to tilt and turn over on its back; said drive means including means for rotating said head from a front facing position to a side facing position during movement of said arms from said first to second position and for moving said doll's head from said side facing position partly back towards said front facing position and then returning it to said side facing position before the arms are moved from said second to said third position.

18. A toy doll comprising a body, a head rotatably mounted on said body for side to side rotary movement, a pair of arms respectively having opposed hand and shoulder end portions, means in said body for articulating said shoulder end portions of the arm of the body for movement in a plurality of planes, and drive means in said body for moving said arms from a first position wherein the hands are spaced apart at about the level of the shoulders of the body to a second position wherein the hands are spaced apart at about the level of the doll's midriff and thence to a third position wherein the hands are adjacent each other at about the level of the doll's midriff whereby when the doll is placed on its midriff on a play surface with its hands on the play surface and its arms in said first position supporting the shoulder portions of the doll off of the play surface, movement of said arms from said first to said second position will cause said doll's body to tilt and turn over on its back; said drive means including means for rotating said head from a front facing position to a side facing position during movement of said arms from said first to second position and for rocking said head in a fore and aft direction.

19. A toy doll comprising a body, a head rotatably mounted on said body for side to side rotary movement, a pair of arms respectively having opposed hand and shoulder end portions, means in said body for articulating said shoulder end portions of the arm on the body for movement in a plurality of planes; and drive means in said body for moving said arms from a first position wherein the hands are spaced apart at about the level of the shoulders of the body to a second position wherein the hands are spaced apart at about the level of the doll's midriff and thence to a third position wherein the hands are adjacent each other at about the level of the doll's midriff whereby when the doll is placed on its midriff on a play surface with its hands on the play surface and its arms in said first position supporting the shoulder portions of the doll off of the play surface, movement of said arms from said first to said second position will cause said doll's body to tilt and turn over on its back; said articulating means including a frame rotatably mounted in said body adjacent the body shoulders for rotation along a first axis extending between said shoulders transversely of the body and pivot means for rotatably mounting the shoulder portions of said arms on said frame for pivotal movement about second axes extending transversely of said first axis whereby the arms will rotate simultaneously with said frame about said first axis and can rotate independently about said second axis; and said drive means including a drive motor, transmission means operatively connected between said motor and said frame for oscillating said frame about said first axis thereby to move said arms between said first and second positions and cooperating means on said pivot means and said body for engaging each other during a predetermined portion of the oscillation of said frame towards the second position of said arms whereby further rotation of the arms with the frame is prevented and continued rotation of the frame causes said arms to pivot about said second axes.

20. A toy doll as defined in claim 19 wherein said cooperating means comprise stop members on the portion of the pivot means connected to said arms and a pair of stop pins in the body located in the plane of rotation of said stop members with the frame and normally spaced therefrom whereby upon oscillation of said frame in a first direction said stop members are brought into engagement with said stop pins whereby further movement thereof in said first direction is blocked and further rotation of the frame in said first direction causes the arms to pivot about their associated second axes.

21. A toy doll as defined in claim 20 wherein said stop members are located in predetermined offset positions with respect to each other whereby one of said stop members engages its associated stop pin before the other stop member to initiate movement of the arm associated therewith from said second to said first position before the other arm.

22. A toy doll as defined in claim 19 wherein said transmission means includes a lever pivotally mounted in said body and having a slot formed in one end thereof adjacent said frame, a crank pin on said frame received in said slot, and a cam having a predetermined configuration rotatably mounted in said body in driving engagement with said motor for rotation thereby and means operatively connecting the cam to the lever whereby rotation of the cam oscillates the lever and frame according to a predetermined pattern controlled by the cam configuration.

23. A toy doll as defined in claim 22 wherein said cam comprises a disc rotatably mounted in said body for rotation in a plane parallel to the plane of oscillation of said lever and having an endless groove formed therein of predetermined shape; said means operatively connecting the lever to the cam comprising a follower pin on said lever received in the groove of said cam.

24. A toy doll comprising a body, a head rotatably mounted on said body for side to side rotary movement, a pair of arms respectively having opposed hand and shoulder end portions, means in said body for articulating said shoulder end portions of the arm on the body for movement in a plurality of planes; and drive means in said body for moving said arms from a first position wherein the hands are spaced apart at about the level of the shoulders of the body to a second position wherein the hands are spaced apart at about the level of the doll's midriff and thence to a third position wherein the hands are adjacent each other at about the level of the doll's midriff whereby when the doll is placed on its midriff on a play surface with its hands on the play surface and its arms in said first position supporting the shoulder portions of the doll off of the play surface, movement of said arms from said first to said second position will cause said doll's body to tilt and turn over on its back; said drive means including means for rotating said head from a front facing position to a side facing position during movement of said arms from said first to said second positions and a drive motor and transmission means operatively connected between said drive motor and said head for converting rotary motion of the drive means to oscillating motion of the head according to a predetermined pattern.

25. A toy doll as defined in claim 24 wherein said transmission means includes an elongated crank having first and second end portions and an intermediate portion therebetween, said first end portion being rigidly connected to said head and said second end portion having an L-shaped bend formed therein including a first leg extending perpendicularly to the intermediate portion of the crank and a second leg extending perpendicularly to the first leg and parallel to the intermediate portion of the crank; means in said body for defining a slot receiving said second end of the crank and means operatively connected between the motor and said crank for rotating the said second leg of the crank in the slot.

26. A toy doll as defined in claim 25 wherein said means for mounting the doll's head on the body includes a universal joint comprising a generally spherical cup mounted in a fixed position in the body and a ball received in said cup and secured to said head; said first end portion of said crank being secured to said ball whereby rotation and movement of the crank causes corresponding rotation and movement of the head.

27. A toy doll as defined in claim 26 wherein said slot is generally L-shaped and has a first leg extending in a fore and aft direction and a second leg extending perpendicularly therefrom towards one side of the doll; and said means operatively connected between the motor and crank comprises means for oscillating said crank in a fore and aft direction whereby when said second leg of the crank moves in the first leg of the slot the head is tilted in a fore and aft direction and when it moves in said second leg of the slot the crank and head are rotated.

28. A toy doll as defined in claim 27 wherein said means for oscillating the crank in a fore and aft direction comprises a lever pivotally mounted in said body on an axis extending transversely of the fore and aft direction, said lever having an opening formed therein freely rotatably receiving said intermediate crank portion; a cam rotatably mounted in said body and operatively engaged with said motor for rotation thereby, said cam having a predetermined configuration, and means on said lever for operatively connecting said lever to said cam whereby said lever is oscillated in a fore and aft direction.

29. A toy doll as defined in claim 28 wherein said cam comprises a disc rotatably mounted in said body for rotation in a plane parallel to the plane of oscillation of said lever and having an endless groove formed therein of predetermined shape; said means operatively connecting the lever to the cam comprising a follower pin on said lever received in the groove of said cam.

30. A toy doll comprising a body, a head, means in said body for mounting the head on the body for fore and aft rocking movement and side to side rotating movement; a pair of arms respectively having opposed hand and shoulder end portions, a frame rotatably mounted in said body adjacent the shoulders of the body for rotation along a first axis extending between said shoulders transversely of the body and pivot means for rotatably mounting the shoulder portions of said arms on said frame for pivotal movement about second axes extending transversely of said first axis whereby the arms will rotate simultaneously with said frame about said first axis and can rotate independently about said second axes; a drive motor in said body and transmission means operatively connected between said motor and said head and frame for:

i. oscillating said frame between first and second extreme positions about said first axis according to a predetermined pattern selected to move said arms from a first position, corresponding to the first position of the frame, wherein said hands are spaced apart at about the level of the shoulders of the body, to a second position wherein the hands are spaced apart at about the level of the doll's midriff, thence to a third position wherein the hands are adjacent each other at about the level of the doll's midriff and thence back to said first position; and ii. for rotating said head from a front facing position to a side facing position, as said arms move from their first to their second position and thereafter returning the head to its front facing position;

whereby when the doll is placed on a flat surface on its midriff with its hands on the surface and its arms in said first position supporting the shoulders of the doll off of the surface movement of said arms from their first to their third positions and rotation of the head to the side facing position will cause the center of gravity of the doll to shift, thereby tipping the doll over on its back in a direction opposite to the direction in which the doll's head faces in said side facing position.

31. A toy doll as defined in claim 30 wherein said arms are mounted on said body in predetermined relative positions with one of said hands at a slightly higher level then the other hand in the first position of said arms whereby said one hand moves above said other hand in the third position of the doll's arms thereby causing the doll's body to tilt towards the side of said one hand.

32. A toy doll as defined in claim 31 wherein said transmission means includes cooperating means on said pivot means and said body for engaging each other during a predetermined portion of the oscillation of said frame towards the second position thereof whereby further rotation of the arms with the frame is prevented and continued rotation of the frame causes said arms to pivot about said second axes.

33. A toy doll as defined in claim 32 wherein said cooperating means comprises stop members on the portion of the pivot means connected to said arms and a pair of stop pins in the body located in the plane of rotation of said stop members with the frame and normally spaced therefrom whereby upon oscillation of said frame in a first direction towards the frame's second position said stop members are brought into engagement with said stop pins whereby further movement in said first direction is blocked and further rotation of the frame in said first direction causes the arms to pivot about their associated second axes.

34. A toy doll as defined in claim 33 wherein said stop members are located in predetermined offset positions with respect to each other whereby one of said stop members engages its associated stop pin before the other stop member to initiate movement of the arm associated therewith from said second to said first position before the other arm.

35. A toy doll as defined in claim 32 wherein said transmission means includes first and second levers pivotally mounted in said body for oscillation about an axis extending below and parallel to said first axis and being respectively associated with said frame and said head; a cam disc rotatably mounted in said body between said lever and drivingly engaged with said motor, said cam disc having opposed sides respectively associated with said levers and having endless cam grooves of predetermined configuration formed therein; means on said levers engaged in their associated cam grooves for following the grooves whereby the levers are oscillated and means operatively connecting said first lever to said frame and said second lever to said head for converting oscillation of the levers into oscillation of the frame and head.

36. A toy doll as defined in claim 35 wherein the means operatively connecting the first lever to the frame comprises a slot in said lever and a crank pin on said frame extending parallel to said first axis and received in said slot.

37. A toy doll as defined in claim 35 wherein said means for mounting the doll's head on the body includes a universal joint comprising a generally spherical cup mounted in a fixed position in the body and a ball received in said cup and secured to said head.

38. A toy doll as defined in claim 37 wherein means operatively connecting the second lever to the head includes an elongated crank having first and second end portions and an intermediate portion; said first end portion being rigidly secured to said ball and said intermediate portion being freely rotatably received in said second lever; said second end portion of the crank having an L-shaped bend formed therein including a first leg extending perpendicularly to the intermediate portion of the crank and a second leg extending perpendicularly to the first leg and parallel to the intermediate crank portion; and means in said body for defining a slot having a slot portion extending parallel to said first axis and receiving said second end leg of the crank whereby oscillation of the second lever oscillates the crank and causes the second leg thereof to slide and rotate in the slot thereby rotating said head according to the pattern determined by the groove in said cam disc.

39. A toy doll as defined in claim 38 wherein said slot is L-shaped and has a first leg extending in a fore and aft direction and a second leg, defining said slot portion, extending perpendicularly from said first slot leg towards one side of the doll, whereby when said second leg of the crank moves in the first leg of the slot the head is tilted in a fore and aft direction and when it moves in said second leg of the slot the crank and head are rotated.

40. A toy doll comprising a body, a head, means for rotatably mounting said head on said body and means for oscillating said head from a front facing position to a side facing position including a drive motor in the body and a transmission operatively connecting the drive motor to the head including an elongated crank having first and second end portions and an intermediate portion therebetween, said first end portion being rigidly connected to said head and said second end portion having an L-shaped bend formed therein including a first leg extending perpendicularly to the intermediate portion of the crank and a second leg extending perpendicularly to the first leg and parallel to the intermediate portion of the crank; means in said body for defining a slot receiving said second end of the crank; said slot extending transversely of said body; and means operatively connected between said motor and said crank for oscillating the crank in a fore and aft direction whereby the second leg of the crank slides and rotates in said slot, thereby rotating said head.

41. A toy doll as defined in claim 40 wherein said means for mounting the doll's head on the body includes a universal joint comprising a generally spherical cup mounted in a fixed position in the body and a ball received in said cup and secured to said head; said first end portion of said crank being secured to said ball whereby rotation and movement of the crank causes corresponding rotation and movement of the head.

42. A toy doll as defined in claim 41 wherein said slot is generally L-shaped and has a first leg extending in a fore and aft direction and a second leg extending perpendicularly therefrom towards one side of the doll whereby when said second leg of the crank moves in the first leg of the slot the head is tilted in a fore and aft direction and when it moves in said second leg of the slot the crank and head are rotated.

43. A toy doll as defined in claim 42 wherein said means for oscillating the crank in a fore and aft direction comprises a lever pivotally mounted in said body on an axis extending transversely of the fore and aft direction, said lever having an opening forced therein freely rotatably receiving said intermediate crank portion; a cam rotatably mounted in said body and operatively engaged with said motor for rotation thereby, said cam having a predetermined configuration, and means on said lever for operatively connecting said lever to said cam whereby said lever is oscillated in a fore and aft direction.

44. A toy doll as defined in claim 43 wherein said cam comprises a disc rotatably mounted in said body for rotation in a plane parallel to the plane of oscillation of said lever and having an endless groove formed therein of predetermined shape; said means operatively connecting the lever to the cam comprising a follower pin on said lever received in the groove of said cam.

45. A toy doll as defined in claim 13 wherein said drive means includes means for simultaneously rocking said head in a fore and aft direction and rotating said head from a front facing position to a side facing position during movement of said arms from said first to said second position.

46. A toy doll comprising a body, a head rotatably mounted on said body, a pair of arms respectively having opposed hand and shoulder end portions; means in said body engaged with said arms for rotatably mounted the shoulder end portions in said body for rotation about a common first axis extending transversely through the body between the shoulder end portions of the arm and second axes respectively associated with the arms extending transversely of said first axis, and drive means in said body for rotating said arms simultaneously about said first axis from a first position wherein the hands are at the level of the doll's shoulders and, after a predetermined amount of rotation when the hands have reached a second position adjacent the doll's midriff, about said second axes to bring said hands towards each other over the doll's midriff; said drive means including means for rocking said head in a fore and aft direction.

47. A toy doll comprising a body, a head rotatably mounted on said body, a pair of arms respectively having opposed hand and shoulder end portions; means in said body engaged with said arms for rotatably mounting the shoulder end portions in said body for rotation about a common first axis extending transversely through the body between the shoulder end portions of the arm and second axes respectively associated with the arms extending transversely of said first axis, and drive means in said body for rotating said arms simultaneously about said first axis from a first position wherein the hands are at the level of the doll's shoulders and, after a predetermined amount of rotation when the hands have reached a second position adjacent the doll's midriff, about said second axes to bring said hands towards each other over the doll's midriff; said drive means including means for rotating the doll's head from a first front facing position to a second side facing position during movement of said arms from their first to their second position and means for rocking said head in a fore and aft direction.

* * * * *